US006994615B2

(12) United States Patent
Easley et al.

(10) Patent No.: US 6,994,615 B2
(45) Date of Patent: Feb. 7, 2006

(54) CUTTING TOOLS WITH TWO-SLOPE PROFILE

(75) Inventors: Thomas Charles Easley, Bexley, OH (US); Shan Wan, Lewis Center, OH (US)

(73) Assignee: Diamond Innovations, Inc., Worthington, OH (US)

( * ) Notice: Subject to any disclaimer, the term of this patent is extended or adjusted under 35 U.S.C. 154(b) by 0 days.

(21) Appl. No.: 10/455,008

(22) Filed: Jun. 5, 2003

(65) Prior Publication Data

US 2004/0067724 A1 Apr. 8, 2004

Related U.S. Application Data

(60) Provisional application No. 60/395,181, filed on Jul. 10, 2002.

(51) Int. Cl.
*B24B 33/00* (2006.01)

(52) U.S. Cl. ..... 451/542; 451/544; 451/548; 51/308

(58) Field of Classification Search ..... 451/540, 451/542, 544, 547, 548; 51/307; 175/420.1, 175/420.2

See application file for complete search history.

(56) References Cited

U.S. PATENT DOCUMENTS

| | | | | | |
|---|---|---|---|---|---|
| 3,136,615 | A | | 6/1964 | Bonvenkerk et al | |
| 3,141,746 | A | | 7/1964 | De Lai et al. | |
| 3,233,988 | A | | 2/1966 | Wentorf, Jr. et al. | |
| 3,743,489 | A | | 7/1973 | Wentorf, Jr. et al. | |
| 3,745,623 | A | | 7/1973 | Wentorf, Jr. et al. | 29/95 |
| 3,767,371 | A | | 10/1973 | Wentorf, Jr. et al. | 51/307 |
| 4,109,737 | A | | 8/1978 | Bovenkerk | 175/329 |
| 5,351,772 | A | | 10/1994 | Smith | 175/428 |
| 5,484,330 | A | | 1/1996 | Flood et al. | 451/540 |
| 5,486,137 | A | * | 1/1996 | Flood et al. | 451/540 |
| 5,494,477 | A | * | 2/1996 | Flood et al. | 451/540 |
| 5,494,777 | A | | 2/1996 | Shiraki et al. | 430/270 |
| 5,743,346 | A | | 4/1998 | Flood et al. | 175/420 |
| 5,871,060 | A | * | 2/1999 | Jensen et al. | 175/420.2 |
| 5,971,087 | A | * | 10/1999 | Chaves | 175/432 |
| 6,202,771 | B1 | * | 3/2001 | Scott et al. | 175/432 |
| 6,405,814 | B1 | * | 6/2002 | Eyre et al. | 175/432 |
| 6,408,959 | B2 | * | 6/2002 | Bertagnolli et al. | 175/432 |
| 6,527,633 | B1 | * | 3/2003 | Tank et al. | 451/548 |
| 2004/0009376 | A1 | * | 1/2004 | Wan et al. | 428/698 |

* cited by examiner

*Primary Examiner*—M. Rachuba
(74) *Attorney, Agent, or Firm*—Pepper Hamilton LLP

(57) ABSTRACT

An abrasive tool insert is formed from a substrate having an inner face that has a center, and annular face which annular face has a periphery. The inner face slopes outwardly and downwardly from the center at an angle ranging from between about 5° and 30° from the horizontal. The annular face surrounds by the inner face and terminates at the periphery. The annular face slopes downwardly and outwardly from the inner face at an angle of between about 20° and 75° from the horizontal. A continuous abrasive layer, having a center and a periphery forming a cutting edge, is integrally formed on the substrate and defines an interface therebetween.

35 Claims, 2 Drawing Sheets

CUTTING TOOLS WITH TWO-SLOPE PROFILE

CROSS-REFERENCE TO RELATED APPLICATIONS

This application claims priority on U.S. Provisional Application Ser. No. 60/395,181, filed on Jul. 10, 2002.

FIELD THE INVENTION

The present invention relates to the field of abrasive tool inserts.

BACKGROUND OF THE INVENTION

Abrasive compacts are used extensively in cutting, milling, grinding, drilling and other abrasive operations. An abrasive particle compact is a polycrystalline mass of abrasive particles, such as diamond and/or cubic boron nitride (CBN), bonded together to form an integral, tough, high-strength mass. Such components can be bonded together in a particle-to-particle self-bonded relationship, by means of a bonding medium disposed between the particles, or by combinations thereof. The abrasive particle content of the abrasive compact is high and there is an extensive amount of direct particle-to-particle bonding. Abrasive compacts are made under elevated or high pressure and temperature (HP/HT) conditions at which the particles, diamond or CBN, are crystallographically stable. For example, see U.S. Pat. Nos. 3,136,615, 3,141,746, and 3,233,988.

A supported abrasive particle compact, herein termed a composite compact, is an abrasive particle compact, which is bonded to a substrate material, such as cemented tungsten carbide.

Abrasive compacts tend to be brittle and, in use, they frequently are supported by being bonded to a cemented carbide substrate. Such supported abrasive compacts are known in the art as composite abrasive compacts. Compacts of this type are described, for example, in U.S. Pat. Nos. 3,743,489, 3,745,623, and 3,767,371. The bond to the support can be formed either during or subsequent to the formation of the abrasive particle compact. Composite abrasive compacts may be used as such in the working surface of an abrasive tool.

Composite compacts have found special utility as cutting elements in drill bits. Drill bits for use in rock drilling, machining of wear resistant materials, and other operations which require high abrasion resistance or wear resistance generally consist of a plurality of polycrystalline abrasive cutting elements fixed in a holder. U.S. Pat. No. 4,109,737 describes drill bits with a tungsten carbide stud (substrate) having a polycrystalline diamond compact on the outer surface of the cutting element. A plurality of these cutting elements then are mounted generally by interference fit into recesses into the crown of a drill bit, such as a rotary drill bit. These drill bits generally have means for providing water-cooling or other cooling fluids to the interface between the drill crown and the substance being drilled during drilling operations. Generally, the cutting element comprises an elongated pin of a metal carbide (stud) which may be either sintered or cemented carbide (such as tungsten carbide) with an abrasive particle compact (e.g., polycrystalline diamond) at one end of the pin for form a composite compact.

Fabrication of the composite compact typically is achieved by placing a cemented carbide substrate into the container of a press. A mixture of diamond grains or diamond grains and catalyst binder is placed atop the substrate and compressed under HP/HT conditions. A composite compact formed in the above-described manner may be subject to a number of shortcomings. For example, the coefficients of thermal expansion and elastic constants of cemented carbide and diamond are close, but not exactly the same. Thus, during heating or cooling of the polycrystalline diamond compact (PDC), thermally induced stresses occur at the interface between the diamond layer and the cemented carbide substrate, the magnitude of these stresses being dependent, for example, on the disparity in thermal expansion coefficients and elastic constants.

Another potential shortcoming, which should be considered, relates to the creation of internal stresses within the diamond layer, which can result in a fracturing of that layer. Such stresses also result from the presence of the cemented carbide substrate and are distributed according to the size, geometry, and physical properties of the cemented carbide substrate and the polycrystalline diamond layer. In some applications, the tools are subject to delamination failures caused by thermally induced axial residual stresses on the outer diameter of the superabrasive layer. The stresses reduce the effectiveness of the tools and limit the applications in which they can be used.

Recently, various PDC structures have been proposed in which the diamond/carbide interface contains a number of non-planar features designed to increase the mechanical bond and reduce thermally induced residual stresses. For example, U.S. Pat. No. 5,351,772 presents various interface designs containing radial raised lands on the substrate. However, high tensile residual stresses still exist at the diamond surface and near the interface in those designs. U.S. Pat. No. 5,484,330 suggests a saw tooth shaped cross-sectional profile and U.S. Pat. No. 5,494,777 proposes an outward sloping profile in the interface design. U.S. Pat. No. 5,743,346 proposes an interface having an inner surface and an outer chamfer that forms a 5° to 85° angle to the vertical, wherein the inner surface is other than the chamfer. U.S. Pat. No. 5,486,137 also proposes a tool insert having an outer downwardly sloped interface surface. U.S. Pat. No. 5,494,477 proposes a tool insert having an outer downwardly sloping interface. U.S. Pat. No. 5,971,087 also proposes various dual and triple slope interface profiles.

It is still highly desirable to provide a polycrystalline diamond compact having reduced axial, radial, and hoop stresses. It is to such cutters that the present invention is addressed.

BRIEF SUMMARY OF THE INVENTION

The invention relates to an abrasive tool insert formed from a substrate having an inner face that has a center, and annular face which annular face has a periphery. The inner face slopes outwardly and downwardly from the center at an angle ranging from between about 5° and 30° from the horizontal. The annular face surrounds by the inner face and terminates at the periphery. The annular face slopes downwardly and outwardly from the inner face at an angle of between about 20° and 75° from the horizontal. A continuous abrasive layer, having a center and a periphery forming a cutting edge, is integrally formed on the substrate and defines an interface therebetween.

The invention further relates to a method for forming an abrasive tool insert, which commences with providing a substrate having an inner face that has a center, and annular face which annular face has a periphery. The inner face slopes outwardly and downwardly from the center at an angle ranging from between about 5° and 30° from the horizontal. The annular face surrounds by the inner face and terminates at the periphery. The annular face slopes downwardly and outwardly from the inner face at an angle of between about 20° and 75° from the horizontal. A continuous abrasive layer, having a center and a periphery forming a cutting edge, is integrally formed on the substrate and defines an interface therebetween.

DETAILED DESCRIPTION OF THE INVENTION

Applicants have found a unique geometry for cutters, wherein a sloped profile is incorporated in the interior of the cutter. In one embodiment of the invention, the sloped profile is combined with a steeper slope on the outer edge of the cutter, further reduces the surface residual stresses.

In one embodiment of the invention, the inventive cutter has an increased useful life with the reduced thermally induced residual radial and axial stresses in the abrasive layer. In another embodiment, the inventive cutter demonstrates increased impact performance and extended working life. These and other advantages of the invention will be apparent to those skilled in the art.

Figure 1:
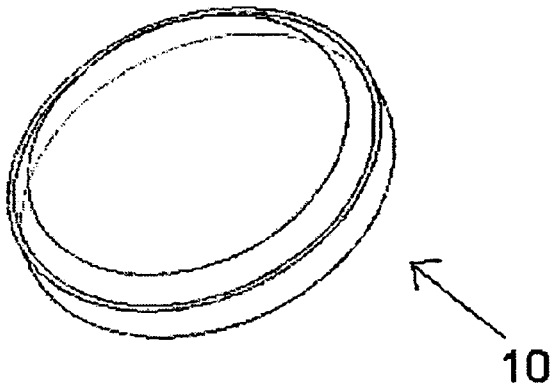
FIG. 1 is a perspective view of one embodiment of the interface configuration of the present invention.
Figure 2:
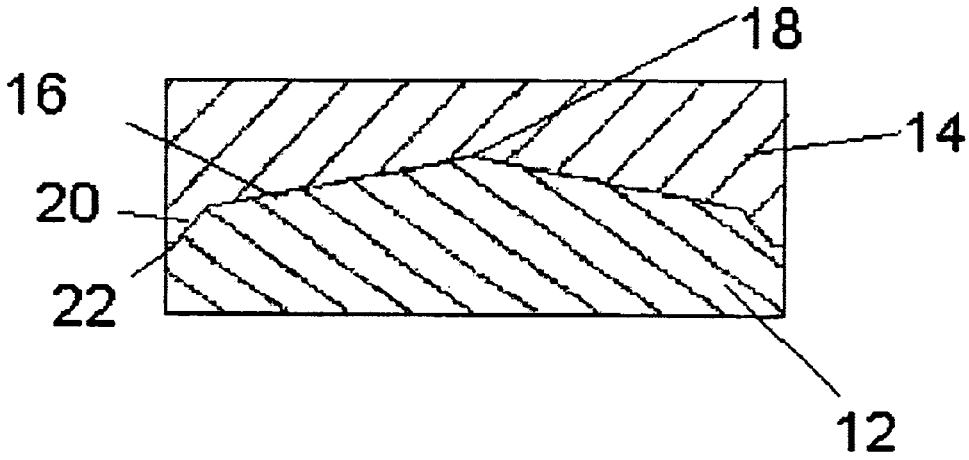
FIG. 2 is a cross-sectional elevational view of the substrate of FIG. 1.

As shown in FIGS. 1 and 2 for one embodiment of the invention, the carbide support contains 2 distinctive faces of support for the abrasive material, each face being disposed at an angle (relative to the horizontal) so as to optimized (minimize) radial stress and axial stress. To that end, a cutter, 10, is formed from a lower support, 12, and an upper abrasive layer, 14 (see FIG. 2). Support 12 has a central, inner face, 16, that extends outwardly and downwardly from an apex or center, 18. Surrounding face 18 is an outer annular face, 20, that extends outwardly and downwardly from the outer periphery of face 16. A slight ledge,22, surrounds the outer periphery of annular face 20. Superimposed on inner face 16 can be saw tooth annuli and troughs, such as are disclosed in U.S. Pat. No. 6,315,652.

In one embodiment of the invention to optimize (minimize) radial stress, outer annular face 20 slopes downwardly from the horizontal at an angle of between about 20° and 75°. In another embodiment, outer annular face slopes downwardly at an angle of about 45°. In another embodiment to optimize (minimize) axial stress, inner face 16 slopes downwardly from the horizontal at an angle of between about 5° and 30°. In yet another embodiment, inner face 16 slopes downwardly at an angle of 7.5°.

The outer surface configuration of the diamond (upper abrasive) layer 14 is not critical. In one embodiment, the surface configuration of the diamond layer, may be in the form of hemispherical, planar, conical, reduced or increased radius, chisel, or non-axisymmetric in shape. In general, all forms of tungsten carbide inserts used in the drilling industry may be enhanced by the addition of a diamond layer, and in one embodiment is further improved by the current invention by addition of a pattern of ridges.

The cutter may be manufactured, in one embodiment by fabricating a cemented carbide substrate 12 in a generally cylindrical shape. The cemented metal carbide substrate is conventional in composition and, thus, may be include any of the Group IVB, VB, or VIB metals, which are pressed and sintered in the presence of a binder of cobalt, nickel or iron, or alloys thereof. Examples include carbides of tungsten (W), niobium (Nb), zirconium (Zr), vanadium (V), tantalum (Ta), titanium (Ti), and hafnium (Hf). In one embodiment, the metal carbide is tungsten carbide. The end face(s) on the carbide substrate are formed by any suitable cutting, grinding, stamping, or etching process.

A sufficient mass of superabrasive material is then placed on the substrate forming the upper abrasive layer 14. In one embodiment, the upper layer is polycrystalline diamond (PCD). In another embodiment, the upper abrasive layer 14 comprises at least one of synthetic and natural diamond, cubic boron nitride (CBN), wurtzite boron nitride, combinations thereof, and like materials.

In one embodiment, the polycrystalline material layer 14 and the substrate 12 are subjected to pressures and temperatures sufficient to effect intercrystalline bonding in the polycrystalline material, and create a solid polycrystalline material layer 14. In another embodiment, chemical vapor deposition may also be used to deposit the polycrystalline material on the substrate 12. This is accomplished by coating the particles of the individual diamond crystals with various metals such as tungsten, tantalum, niobium, or molybdenum, and the like by chemical vapor techniques using fluidized bed procedure. Chemical vapor deposition techniques are also known in the art which utilize plasma assisted or heated filament methods.

The invention relates particularly to tool inserts having a support with a central downwardly sloping profile and an outer steeper sloping profile, which reduces the surface axial residual stresses by 83% compared to a flat, planar interface and by 23% compared to a substrate with a single sloped rim. The reduction of the surface axial residual stress increases the impact performance and extends the working lifetime of the cutting tool.

EXAMPLES

Applicants have performed finite element analysis (FEA) of the inventive cutter versus the prior art polycrystalline diamond cutters, one having a flat interface and one having a single slope interface for a cutting tool with 19 mm diameter, 16 mm overall height, and 3 mm diamond table thickness. For the inventive cutter, the outer annular face had an angle of 45° with respect to the horizontal, while the inner face angle varied between about 0° and 30° from the horizontal.

The cutting tool insert is manufactured by conventional high pressure/high temperature (HP/HT) techniques well known in the art. Such techniques are disclosed, inter alia, in the art cited above.

Figure 3:
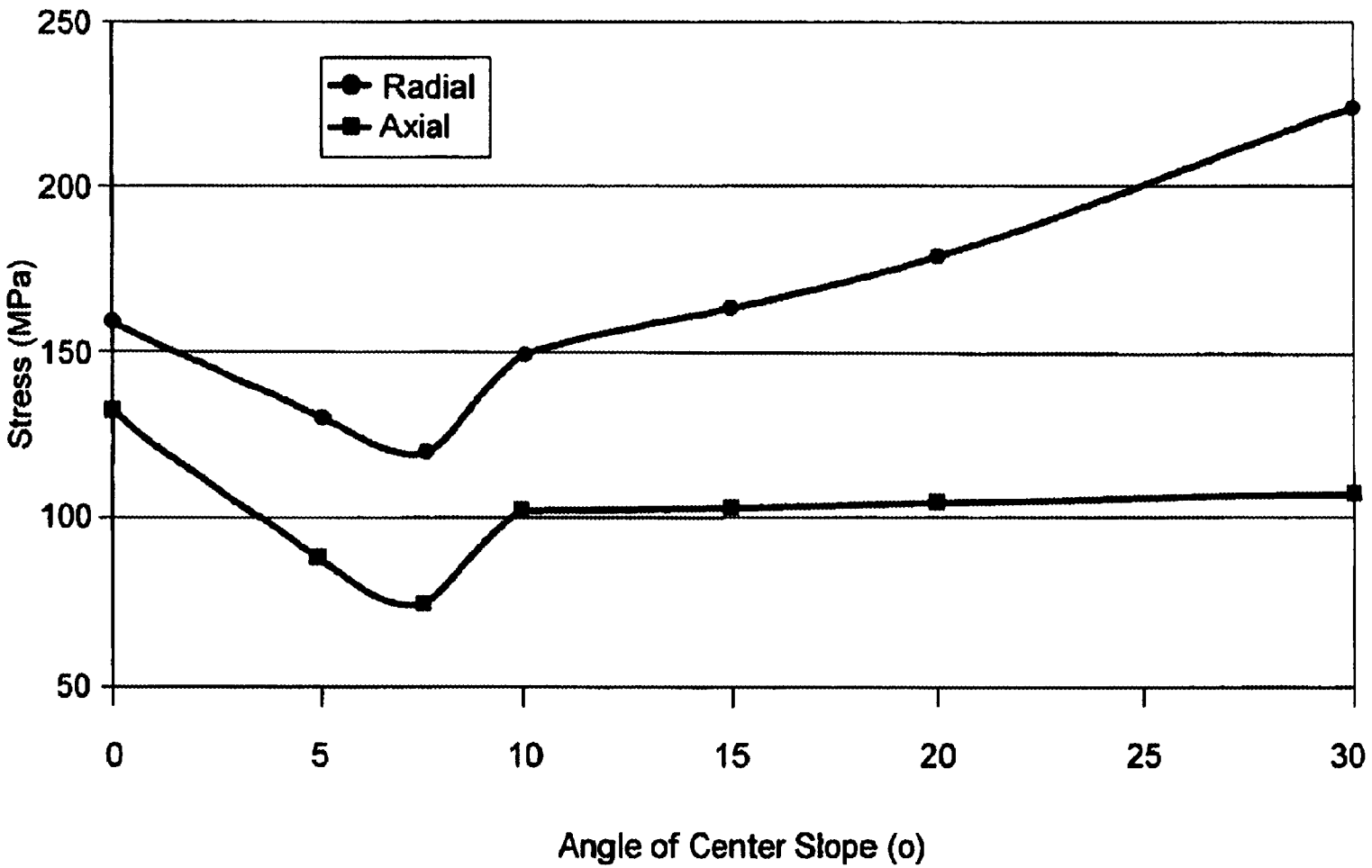
FIG. 3 graphically displays the stress (MPa) versus inner face angle for a cutter element having the profile as depicted in FIG. 2.

The FEA analyses show that both radial and axial stress is minimized at about 7.5° with an optimized (minimized) range of stresses being expected at about 5° to 30° from the horizontal. The results of FEA modeling using ABACUS is set forth in FIG. 3 and in Table 1 below.

TABLE 1

| Stress in MPa | (1) Flat Interface | (2) Single Sloped Interface, 45° | (3) Double Sloped Interface, 10° and 45° |
|---|---|---|---|
| Maximum surface tensile axial stress | 595 | 132 | 102 |
| Maximum surface tensile radial stress | 300 | 160 | 151 |
| Maximum surface tensile hoop stress | 88 | 0 | 0 |

In a Parkson Mill Impact Resistance test to evaluate interrupted cut impact testing on a granite block in a fly cutter configuration, the inventive cutter is compared to a single slope tool insert of the prior art. In the Parkson Mill Impact Resistance test, the performance of the cutter on a chamfer piece is measured, with each piece having a carbide chamfer of greater than about 0.2 mm, less than 1.0 mm radial or 45° on the locating base. The cutter (0.010" chamfered edge) sample is mounted in a steel holder, with Rake angle to work piece 7 deg radial/12 degrees axial. The cutter is rotated and cuts in an interrupted fashion at a depth of 0.150" and transverse distance of 0.010" through a granite work piece at a cutting speed of 320 rpm and feed rate of about 3" per min. (7.62 cm/min). The test is stopped when the diamond table fails, and the number of impacts (entries into the block) counted.

The inventive cutter shows unexpected improvement in impact resistance, with a count of 12600 as opposed to 11500 for the cutter of the prior art.

While the invention has been described with reference to a preferred embodiment, those skilled in the art will understand that various changes may be made and equivalents may be substituted for elements thereof without departing from the scope of the invention. In addition, many modifications may be made to adapt a particular situation or material to the teachings of the invention without departing from the essential scope thereof. Cutting elements according to one or more of the disclosed embodiments may be employed in combination with cutting elements of the same or other disclosed embodiments, or with conventional cutting elements, in paired or other grouping, including but not limited to, side-by-side and leading/trailing combinations of various configurations.

All citations referred herein are expressly incorporated herein by reference.

What is claimed is:

1. An abrasive tool insert, which comprises:

a substrate having an inner face which has a center, and an annular face which has a periphery, said inner face sloping outwardly and downwardly from said center at an angle ranging from between about 5° and 15° from the horizontal, an annular face which surrounds said inner face, which annular face terminates at said periphery and which slopes downwardly and outwardly from said inner face at an angle of between about 20° and 75° from the horizontal; and a continuous abrasive layer having a center, a periphery forming a cutting edge, being integrally formed on said substrate, and defining an interface therebetween, and wherein the abrasive layer has a thickness of at least about 0.1 mm.

2. The abrasive tool insert of claim 1, wherein said substrate comprises cemented metal carbide.

3. The abrasive tool insert of claim 2, wherein said cemented metal carbide is one or more of Group IVB, Group VB, and Group VIB metal carbides.

4. The abrasive tool insert of claim 1, wherein said abrasive layer is one or more of diamond, cubic boron nitride, wurtzite boron nitride, and combinations thereof.

5. The abrasive tool insert of claim 3, wherein said abrasive layer is one or more of diamond, cubic boron nitride, wurtzite boron nitride, and combinations thereof.

6. The abrasive tool insert of claim 1, wherein said annular face angle is about 45° from the horizontal.

7. The abrasive tool insert of claim 1, wherein the annular face terminates in a ledge surrounding the periphery of said annular face.

8. A method for forming an abrasive tool insert, which comprises the steps of:

forming a substrate having an inner face that has a center, and annular face which annular face has a periphery, said inner face sloping outwardly and downwardly from said center at an angle ranging from between about 5° and 15° from the horizontal, said inner face surrounded by an annular face that terminates at said periphery and which annular face slopes downwardly and outwardly from said inner face at an angle of between about 20° and 75° from the horizontal; and integrally forming on said substrate a continuous abrasive layer having a center and a periphery forming a cutting edge, wherein the abrasive layer has a thickness of at least about 0.1 mm.

9. The method of claim 8, wherein said substrate comprises cemented metal carbide.

10. The method of claim 9, wherein said cemented metal carbide is one or more of Group IVB, Group VB, and Group VIB metal carbides.

11. The method of claim 8, wherein said abrasive layer is one or more of diamond, cubic boron nitride, wurtzite boron nitride, and combinations thereof.

12. The method of claim 10 wherein said abrasive layer is one or more of diamond, cubic boron nitride, wurtzite boron nitride, and combinations thereof.

13. The method of claim 8, wherein said annular face angle is about 45° from the horizontal.

14. The method of claim 8, wherein the annular face terminates in a ledge surrounding the periphery of said annular face.

15. A method for improving one or more of radial stress or axial stress of an abrasive tool insert, which comprises the steps of:

forming a substrate having an inner face that has a center, and annular face which annular face has a periphery, said inner face sloping outwardly and downwardly from said center at an angle ranging from between about 5° and 15° from the horizontal, said inner face surrounded by an annular face that terminates at said periphery and which annular face slopes downwardly and outwardly from said inner face at an angle of between about 20° and 75° from the horizontal; and integrally forming on said substrate a continuous abrasive layer having a center and a periphery forming a cutting edge, wherein the abrasive layer has a thickness of at least about 0.1 mm.

16. The method of claim 15, wherein said substrate comprises cemented metal carbide.

17. The method of claim 16, wherein said cemented metal carbide is one or more of Group IVB, Group VB, and Group VIB metal carbides.

18. The method of claim 15, wherein said abrasive layer is one or more of diamond, cubic boron nitride, wurtzite boron nitride, and combinations thereof.

19. The method of claim 18, wherein said abrasive layer is one or more of diamond, cubic boron nitride, wurtzite boron nitride, and combinations thereof.

20. The method of claim 15, wherein said annular face angle is about 45° from the horizontal.

21. The method of claim 15, wherein the annular face terminates in a ledge surrounding the periphery of said annular face.

22. An abrasive tool insert, which comprises:

a substrate having an inner face which has a center, and an annular face which has a periphery, said inner face sloping outwardly and downwardly from said center at an angle ranging from between about 5° and 15° from the horizontal, an annular face which surrounds said inner face, which annular face terminates at said periphery and which slopes downwardly and outwardly from said inner face at an angle of between about 20° and 75° from the horizontal;

a continuous abrasive layer having a center, a periphery forming a cutting edge, being integrally formed on said substrate, and defining an interface therebetween;

wherein the abrasive layer has a thickness of at least about 0.1 mm; and wherein the interface is non-planar.

23. The abrasive tool insert of claim 22, wherein said substrate comprises cemented metal carbide.

24. The abrasive tool insert of claim 23, wherein said cemented metal carbide is one or more of Group IVB, Group VB, and Group VIB metal carbides.

25. The abrasive tool insert of claim 22, wherein said abrasive layer is one or more of diamond, cubic boron nitride, wurtzite boron nitride, and combinations thereof.

26. The abrasive tool insert of claim 22, wherein said non-planar interface comprises a sawtooth pattern of concentric rings.

27. The abrasive tool insert of claim 22, wherein said annular face angle is about 45° from the horizontal.

28. The abrasive tool insert of claim 22, wherein the annular face terminates in a ledge surrounding the periphery of said annular face.

29. A method for forming an abrasive tool insert, which comprises the steps of:

forming a substrate having an inner face that has a center, and annular face which annular face has a periphery;

said inner face sloping outwardly and downwardly from said center at an angle ranging from between about 5° and 15° from the horizontal;

said inner face surrounded by an annular face that terminates at said periphery and which annular face slopes downwardly and outwardly from said inner face at an angle of between about 20° and 75° from the horizontal;

integrally forming on said substrate a continuous abrasive layer having a center and a periphery forming a cutting edge;

wherein the abrasive layer has a thickness of at least about 0.1 mm; and wherein the interface is non-planar.

30. The method of claim 29, wherein said substrate comprises cemented metal carbide.

31. The method of claim 30, wherein said cemented metal carbide is one or more of Group IVB, Group VB, and Group VIB metal carbides.

32. The method of claim 29, wherein said abrasive layer is one or more of diamond, cubic boron nitride, wurtzite boron nitride, and combinations thereof.

33. The method of claim 29, wherein said non-planar interface comprises a sawtooth pattern of concentric rings.

34. The method of claim 29, wherein said annular face angle is about 45° from the horizontal.

35. The method of claim 29, wherein the annular face terminates in a ledge surrounding the periphery of said annular face.

* * * * *